United States Patent [19]

Volke et al.

[11] Patent Number: 4,468,143

[45] Date of Patent: Aug. 28, 1984

[54] DEVICE FOR THE MOUNTING OF A PRINTING HEAD AND FOR THE MOUNTING AND GUIDANCE OF AN INK RIBBON FOR A PRINTER

[75] Inventors: Hans-Werner Volke, Salzkotten; Jürgen Hilkenmeier, Paderborn; Hermann Kohlhage, Paderborn; Udo Tewes, Paderborn, all of Fed. Rep. of Germany

[73] Assignee: Nixdorf Computer AG, Fed. Rep. of Germany

[21] Appl. No.: 430,545

[22] Filed: Sep. 30, 1982

[30] Foreign Application Priority Data

Apr. 20, 1982 [DE] Fed. Rep. of Germany ..... 3214633

[51] Int. Cl.[3] ..... B41J 35/06; B41J 32/02

[52] U.S. Cl. ..... 400/248; 400/196; 400/352

[58] Field of Search ..... 400/194, 196, 196.1, 400/207, 208, 247, 248, 248.1, 320, 352, 353, 175, 250

[56] References Cited

U.S. PATENT DOCUMENTS

| | | | |
|---|---|---|---|
| 3,731,781 | 5/1973 | Claudill et al. | 400/208 |
| 3,987,883 | 10/1976 | Darwin et al. | 400/248 |
| 4,088,218 | 5/1978 | Depew | 400/208 |
| 4,110,050 | 8/1978 | Wood et al. | 400/248 |
| 4,165,188 | 8/1979 | Rempel | 400/248 |
| 4,239,402 | 12/1980 | Jung et al. | 400/175 |
| 4,325,645 | 4/1982 | Miyajima et al. | 400/208 |
| 4,391,541 | 7/1983 | Einem | 400/248 |

FOREIGN PATENT DOCUMENTS

| | | | |
|---|---|---|---|
| 2058719 | 4/1981 | United Kingdom | 400/248.1 |

*Primary Examiner*—Edgar S. Burr
*Assistant Examiner*—David A. Wiecking
*Attorney, Agent, or Firm*—Krass & Young

[57] ABSTRACT

Apparatus for guiding an ink ribbon for a printer, with top edges standing perpendicularly to and inclined forward toward the printing plane, over which the ink ribbon laid on flange plates which act as slides when fed further and threads in itself. At the same time means for the quick fixing of the print head are provided on the apparatus serving for the guiding of the ink ribbon.

4 Claims, 5 Drawing Figures

DEVICE FOR THE MOUNTING OF A PRINTING HEAD AND FOR THE MOUNTING AND GUIDANCE OF AN INK RIBBON FOR A PRINTER

DESCRIPTION

1. Introduction

The invention relates to an apparatus for the support and guiding of an interchangeable print head as well as for supporting and guiding an interchangeable ink ribbon for a printer, including a carrier with receptacles for supporting and fastening the print head as well as the ink ribbon spools or the like and also with means for guiding the ink ribbon approximately in the printing place.

2. Background of the Invention

In numerous modern printers, which in the broadest sense in also understood to include typewriters, and particularly in printers with a print head arranged to be movable in the line direction along the platen arranged stationary, both the print head and the ink ribbon are arranged replaceably on a common carrier and move with this. For this it is essential for the print head and the ink ribbon to be rapidly and easily replaceable and that they be securely held in their exact alignment with the printing plane even with the rapid operation of modern rapid printers.

Apparatus of the type mentioned at the start are already known in which the replacement of a complete set consisting of print head and ink ribbon is very bothersome, since the ink ribbon on the one hand must be threaded between a number of guide plates placed in staggered form, and since for the removal of the print head a sheet metal cover plate must be unscrewed and after the insertion of the print head this must be screwed back on, so that for example without a suitable tool this replacement cannot be done.

SUMMARY OF THE INVENTION

It is the problem of the present invention to create an apparatus of the type mentioned at the start in which the replacement of the ink ribbon as well as of the print head can be done simply and without any tool, whereby a perfect alignment, especially of the print head to the ink ribbon and also to the printing plane as well as a fixing of the print head is to be ensured.

This problem is solved according to the invention by having a headpiece connected to the carrier, on which piece are built at least two flange plates arranged on either side of the printing region, standing approximately perpendicularly to the printing plane and transversely to the lengthwise direction of the ink ribbon, over the front edge of which flange plates, situated in the printing plane, the ink ribbon is guided by having a guide pin or the like, for the guiding of the side of the ink ribbon turned toward the paper, built outside of the printing region enclosed by the flange plates and next to the flange plates, the pin protruding out above the upper edge of the flange plates, by having the upper edges of the flange plates run down at least partly inclined toward the printing plane, and by having means provided on the headpiece for adjusting in position and quick locking of the print head.

When the new ink ribbon is inserted, this is first laid on the upper edges of the two flange plates. When the ink ribbon is fed forward, because of the at least partly inclined shape of the upper edges of the flange plates, the ribbon slips down of itself over the upper edges of the flange plates and into a position in which it lies against the front edges of the flange plates. The guiding of the side of the ink ribbon turned toward the paper is done by the two guide pins. Since these protrude up over the upper edges of the flange plates, it is reliably ensured that the ink ribbon will slip between these flange plates and the guide pins. The friction of the ink ribbon between the flange plates and the guide pins ensures that the ink ribbon is at least lightly stretched in the printing region. The print head is aligned exactly with the ink ribbon and also with the printing plane by means arranged on the headpiece itself, and is fastened onto the latter by a quick locking.

In a further development of the invention it is provided that another outer ridge with a front edge set back with respect to the front edges of the inner flange plates as well as a more highly inclined top edge is arranged outside of the region delimited by the guide pins, that the outer flange plates are arranged to the inner ridges at an angle opening outward to the ink ribbon, and that apparatus are provided on the carrier for feeding the ink ribbon to or carrying it away from the headpiece, which apparatus are arranged set back with respect to the front edges of the inner flange plates and of the outer flange plates.

The apparatus for feeding or carrying away the ink ribbon are for example the ink ribbon spools themselves, or in the case of the use of ink-ribbon magazines, deflection rolls arranged laterally on the carrier, as will be described more accurately on the basis of the embodiment example. The embodiment of the headpiece as described improves the automatic threading-in operation by reason of the additional more highly sloping flange plates. After its insertion the ink ribbon, starting from the two inner flange plates, is led in a bent-down curve respectively over the set-back front edges of the outer flange plates as well as the feeding and carrying-away apparatus which are set back still further with respect to these, and thereby is always held lightly stretched.

In a printer with matrix printer head, it is provided according to the invention that the two inner flange plates serve for the lateral support of the needle channel formed on the matrix printer head, that stops are provided for supporting the matrix printer head in a direction perpendicular to the printing plane and that a spring buckle overlapping the needle channel and gripping this on the headpiece is provided for fixing the matrix printer head.

A matrix printer head generally consists of the case containing the folding anchor for operating the needles as well as a needle channel arranged on it for guiding the thin needles. The print head case is arranged on the carrier in an inherently known manner. The precise alignment of the print head specifically to the ink ribbon, however, is done through means arranged on the print head itself. Here the two inner flange plates according to the invention serve at the same time as a lateral support for this needle channel. Separate stops are provided for aligning the print head perpendicularly to the printing plane. A spring buckle which is operated without any tool serves for fixing the print head.

In one development of the invention the stops for supporting the matrix printer head are built as uprights standing approximately parallel to the printing plane, where the spring buckle is pivoted on one of the uprights and can be held behind a lug arranged on the outer upright.

The headpiece is preferably built as a separate part to be fastened onto the carrier. Therefore it can be designed and fabricated without regard to the material and the manner of fabrication of the carrier. According to the invention it is preferably made as an injection molded plastic part.

According to a further feature of the invention the guide pins are not integrated with the headpiece but can be screwed into threaded bore holes formed on the headpiece. Thus they can serve at the same time for the fixing of guide means fastened on the carrier for guiding the paper to be printed.

An embodiment example of the invention is represented in the drawings and described more fully in the following. In these:

DETAILED DESCRIPTION OF THE SPECIFIC EMBODIMENTS

Figure 1:
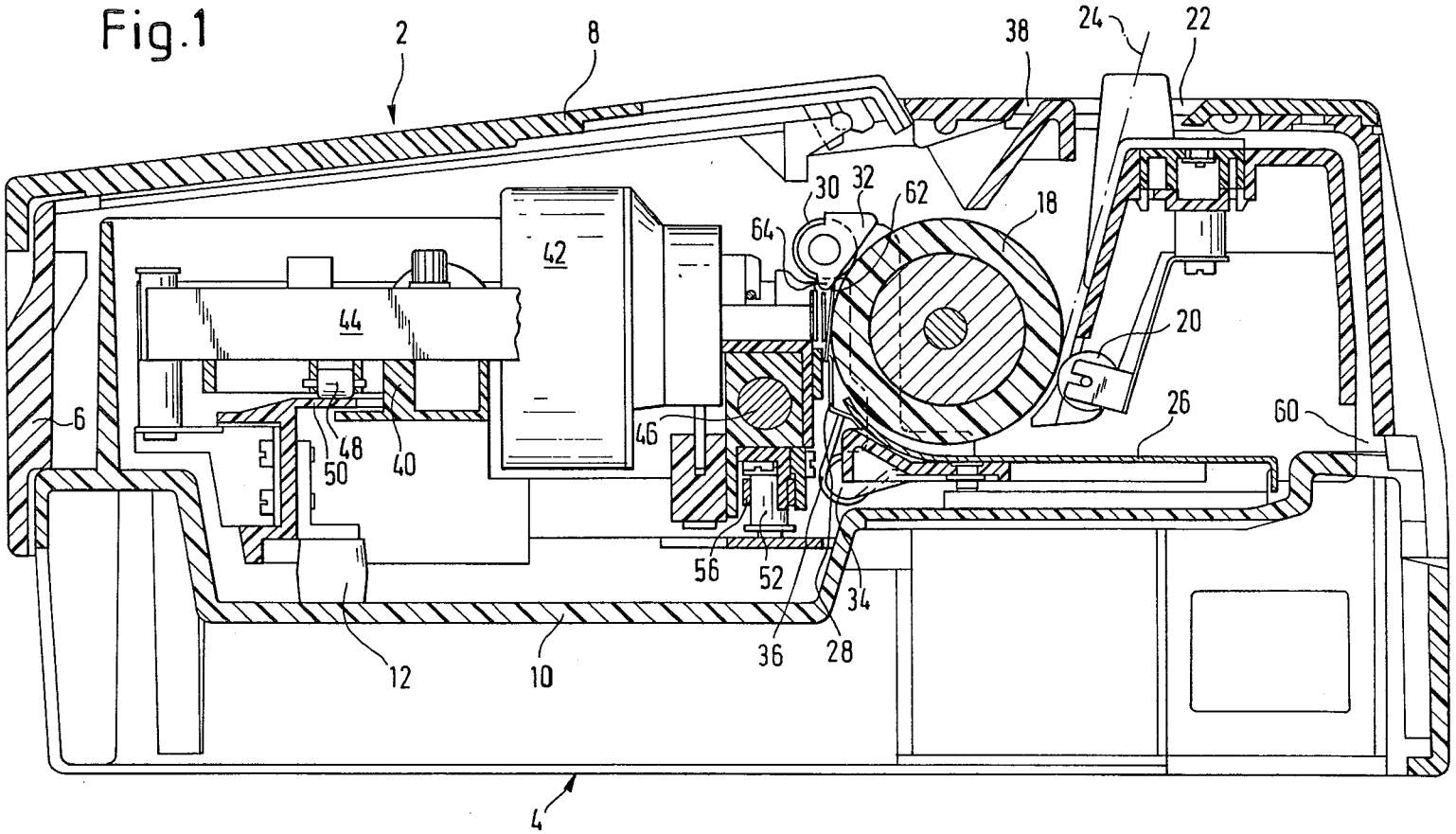
FIG. 1 shows a longitudinal section through a printer.

The printer apparatus shown in FIG. 1 is accommodated in a multipart housing 2. This consists of a bottom pan 4, a top pan 6 placed on this and a covering cap 8. The whole of the control and program electronics as well as the power part is accommodated in the bottom pan 4, for example by means of a plug-in unit. The bottom pan 4 is closed off above by an intermediate bottom 10 and thus separates the electrical part from the printing mechanism proper arranged in the upper pan 6. The covering cap 8 closes off the top pan in a manner largely secure from dirt as well as sound-damping. In addition special covers can be provided for the feeding and delivery openings for the paper.

The top pan 6 containing the printing mechanism is fastened by way of vibration-damping feet 12 onto the intermediate pan 10. The printing mechanism includes a platen 18 mounted to be rotatable and driven by a driving motor 14 by way of gearing means 16, see also FIG. 2. Feed rolls 20 cooperate with the platen 18, which rolls grasp a sheet of paper 24 fed through the feeding opening 22 in the covering cap and—and with a rotation of the platen 18—convey it further. The sheet of paper is guided around the platen 18 by a guide plate 26. Adjacent to the guide plate 26 there is another guide plate 28 arranged substantially tangential to and spaced apart slightly from the platen 18. Behind the printing region of the platen 18 in turn are provided feed rolls which are arranged on a common roll carrier 32. The roll carrier 32 is pivoted on a shaft 34 and is loaded by springs 36 in such a way that the feed rolls 30 are pressed against the platen 18. The feed rolls 30 take over the paper after it has passed through the print region and convey it to delivery openings 38. The roll carrier 32 can be swiveled away from the platen, thereby making the feed rolls 30 inactive.

In the upper pan 6 a carrier 40 is mounted in a movable manner in the line direction, which serves for receiving a print element 42 as well as an ink ribbon magazine 44. In the platen region the carrier 40 is mounted in a movable manner on a supporting shaft 46 arranged parallel to the platen 18. At its end remote from the platen 18 the carrier 40 is supported by way of a guide roll 48 on a guide track 50 on the top pan 6. Because the supporting shaft 46 is arranged far in front of and below the print region, the reaction forces of the printing operation as well as the weight of the print element 42 and of the ink ribbon magazine 44 act on the supporting shaft 46 only to rotate it counterclockwise in FIG. 1, so that the guide roll 48 is sufficient for supporting the carrier 40; lifting forces do not occur in this region.

In order to exclude reliably any tilting of the carrier, the movement drive of the carrier 40 is arranged directly under the supporting shaft 46. It consists of a timing belt 56 passed around two deflecting rolls 52, 54, one side of which belt is connected with the carrier 40. The deflection roll 54 is located directly on the shaft of the driving motor 58.

Figure 2:
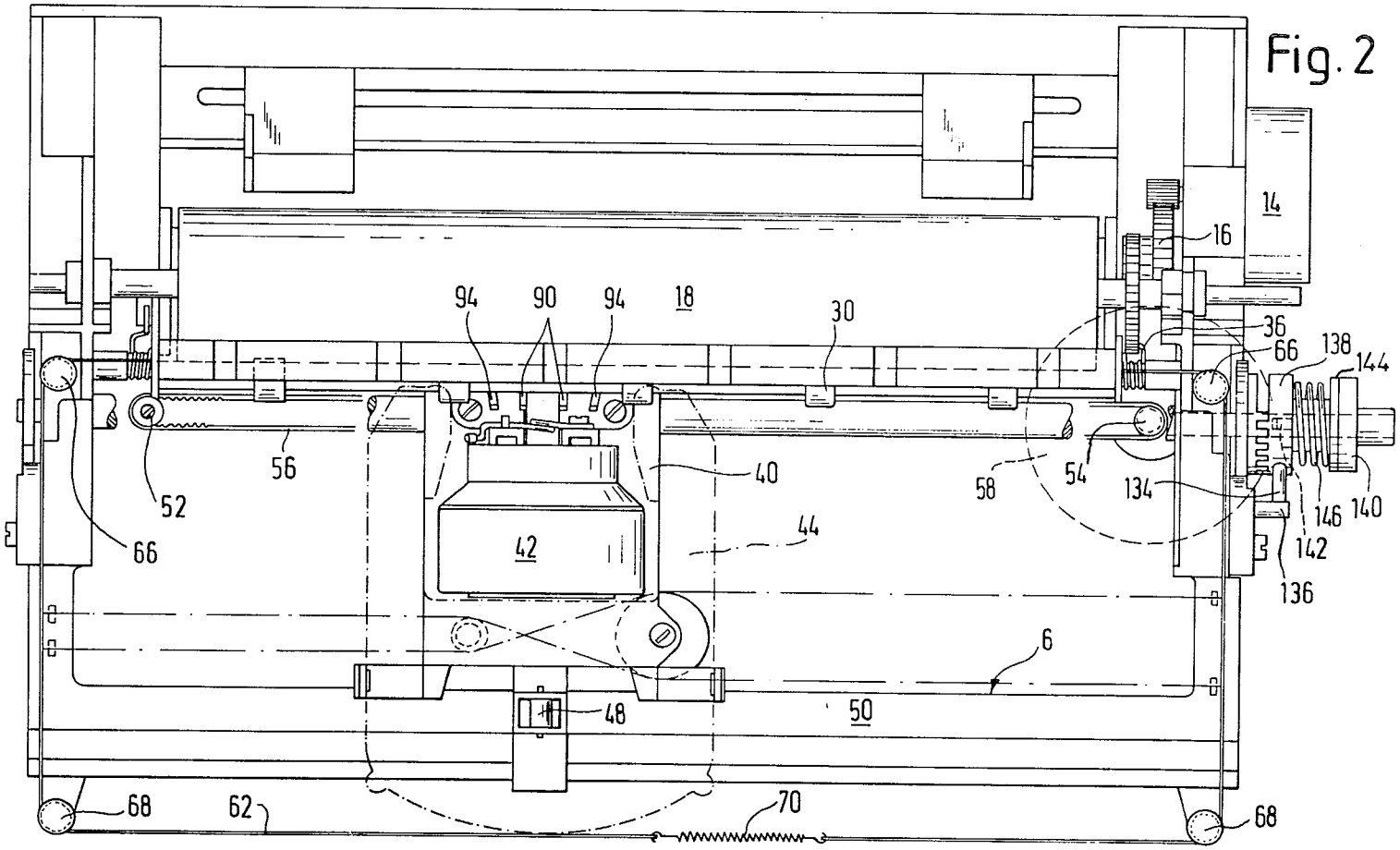
FIG. 2 shows a top plan view of a printer according to FIG. 1.

In addition to the feed opening 22, which is predominantly for single sheets or paper running off a roll, another feed opening 60 serving to feed margin-perforated endless paper is provided on the back side of the housing 2. Since this paper is conveyed further by special conveying means engaging in the margin perforation, it by passes the feed rolls 20 while the feed rolls 30 are lifted off. Both types of paper are fed to the print region by means of the guide plates 26 and 28. In order to ensure a reliable positioning of the paper in the print region on the platen 18 and in order to exclude any hooking of the paper on parts of the apparatus or of the print element with certainty, a belt 62 is provided parallel to the platen 18 and approximately tangential to and spaced apart slightly from this. This engages with its lower edge over the guide plate 28 on the one hand, and on the other hand engages with its top edge under a lug 64 arranged on the roll carrier 32. The belt 62 is situated either spaced apart by the thickness of the paper from the surface of the platen or lies directly against it. In this manner the paper in the print region always lies firmly against the surface of the platen 18 in the print region, even when it has not yet been grasped by the feed rolls 30 or the separate conveying unit provided for the endless paper. This ensures that the paper is printed exactly and neatly without losses at the edges. As FIG. 3 in particular shows, the belt 62 is connected with the print element arrangement, especially the carrier 40, so that it is carried along by the latter in the line direction. As FIG. 2 shows, the belt 62 is designed as an endless belt and is guided over deflecting rollers 66 arranged in the region of the platen ends as well as deflecting rollers 68 arranged behind the print element arrangement. In order to keep the belt 62 stretched, a spring 70 holding together the two belt ends is provided for example. Directly in front of the print element 42 constructed as a matrix printer head the belt 62 shows a perforation 72 so that the printing stylus can act effectively against the paper lying against the platen by way of the ink ribbon 75. For fastening the belt 62 onto the carrier 40, two shackles 74 are formed on the belt which can be firmly clamped by means of screweon pins 76.

The ink-ribbon magazine 44 and the print element 42 are arranged replaceably on the carrier 40. As FIG. 4 in particular shows, there is a receptacle 78 formed on the carrier 40 for the print element 42 in which the latter can be inserted. Two arms 80 formed laterally on the carrier 40 serve for securing the magazine, wherewith projections 82 formed on the arms elastically snap into recesses 84 formed on the magazine. A head part 86 which has a number of functions is fastened by means of bolts 88 onto the region of the carrier turned toward the platen. On the one hand the belt 62 is fastened onto it by means of pins 76 and the shackles 74. On the other hand, the head part serves for guiding the ink ribbon 75. Flange plates 90 are arranged on the head part 86 on both sides of the recording or printing region. The upper edges 92 of the flange plates drop off at least partly in the direction of the printing plane. Besides these two flange plates there are arranged other flange plates 94 which are arranged adjacent to the flange plates 90 in a rather broad angle to the ink ribbon, (see also FIG. 2.) The upper edges 96 of the flange plates 94 are designed dropping off more sharply than those of the flange plates 90. When the ink ribbon magazine 44 is placed on the carrier 40, the ink ribbon 75 first lies loosely on the upper edges 92 and 96. When the ink ribbon 75 is advanced, it slides down off of the oblique upper edges 92, 96 and is threaded automatically between the front edges 98 of the flange plates 90 and the pins 76. In order to ensure this operation reliably, the pins 76 are made higher than the upper edges 92, so that the ink ribbon 75 cannot slip over the pins 76. The front edges 100 of the outer flange plates 94 are set back somewhat from the front edges 98. The guide lugs 102 formed on the ink-ribbon magazine 44 for guiding the ink ribbon in and out are set back in turn with respect to the front edges 100. In this way the ink ribbon runs around the front edges 98, 100 and the guide lugs 102 somewhat in the shape of a polygonal train and remains slightly stretched due to the friction occurring there. This effect is increased still further by having the pins extend slightly into the path of the ink ribbon between the ridges 90 and 94.

Figure 3:
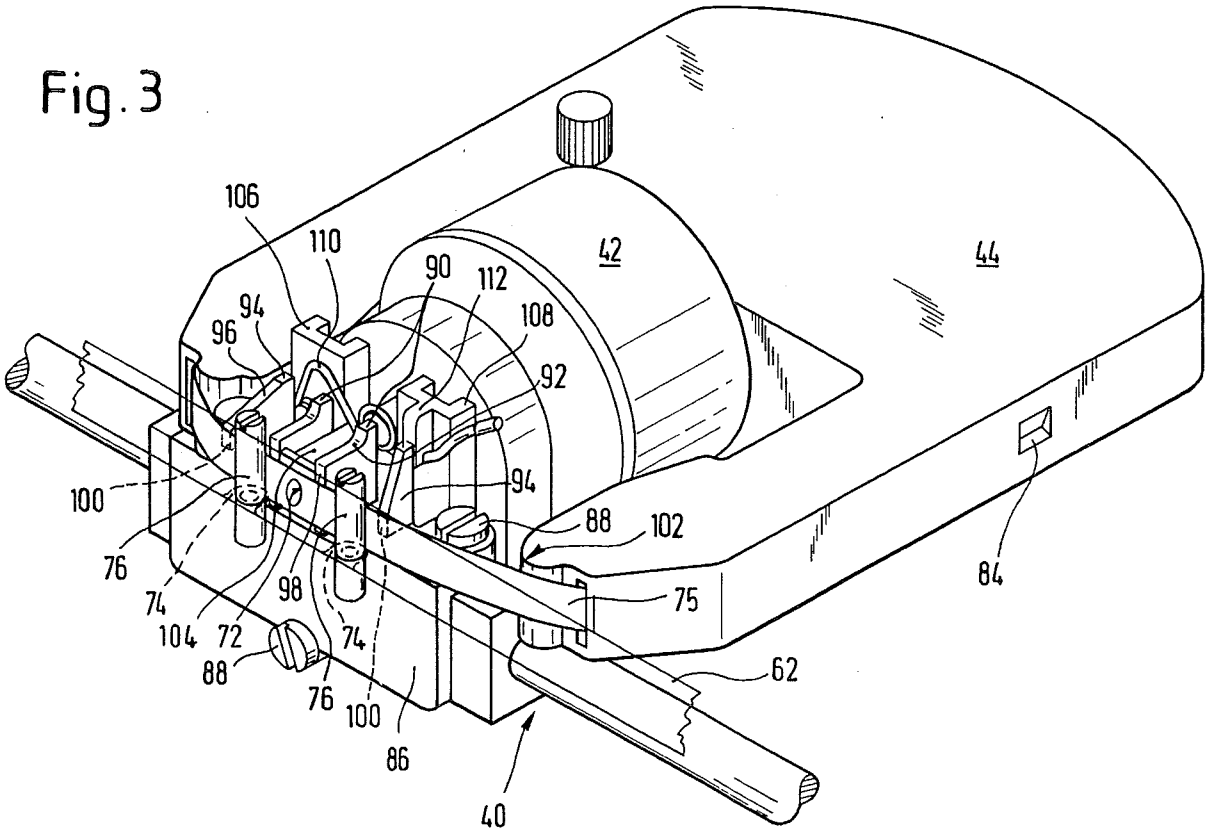
FIG. 3 shows a perspective view of the print head arrangement of a printer according to FIG. 1.

As FIGS. 2 and 3 show, the inner flange plates 90 at the same time serve as a lateral support for the needle channel 104 of the print element 42. Two upright supports 106, 108 standing on the print element serve for the emplacement of the print element 42 in a direction perpendicular to the printing plane. A spring buckle 110 arranged pivoting on the upright support 106 can be swiveled over the needle channel 104 and be locked under a lug 112 formed on the upright support 108.

In order to be able to adjust the spacing of the print element from the platen 18 to match exactly the thickness of the paper to be printed, to a number of positions if necessary, the whole carrier 40 is movable in a direction perpendicular to the printing plane. For this the supporting shaft 46 is mounted to be movable parallel to itself, in the housing, here the lower pan 6, as FIG. 4 in particular shows. The supporting shaft 46 is also mounted to be rotatable. In each of its end regions there are eccentric disks 114 joined rotationally fixed to it. The radial cams 116 of the eccentric disks 114 are supported against support surfaces 120 formed on a supporting frame 118. The supporting frame 118 is fastened in movable form on the upper pan 6 for the purpose of an exact adjustment. The supporting shaft 46 is loaded by springs 122 in such a way that the radial cam 116 of the eccentric disk 114 is always pressed against the supporting surfaces 120. By rotating the eccentric disk 114 together with the supporting shaft 46 this is pushed in one direction or the other corresponding to the varying eccentricity of the radial cam 116. As is shown particularly in FIG. 5, the radial cam 116 shows a first region $\alpha$ in which its eccentricity varies only slightly. This region serves for the fine adjustment of the print element 42, for example in the range of millimeters or fractions of a millimeter and permits fitting various thicknesses of paper. In the region $\beta$ of the radial cam 116 the eccentriciy changes very marked, so that for a small angle of rotation of the eccentric disk 114 the print element is shifted by a large amount. This region serves for raising the print element for inserting new paper.

The rotation of the eccentric disk 114 is absolutely limited in the lifting direction by stops 124 formed on it and in the feed direction by stops 126. These stop surfaces then lie against the support surface 120 of the support frame 118. For adjusting the eccentric disk 114, a feed knob 132 is provided which can be coupled with this disk by way of the gearings 128, 130. The adjusting knob 132 as a whole is mounted to be rotatable and movable on the supporting shaft 46. The angle of rotation of the adjusting knob 132 in the feed direction is limited by a stop pin 134 arranged on the adjusting knob as well as a stop 136 formed on the support frame 118. In a starting position the adjusting knob 132 is arranged in an angular position to the eccentric disk 114 such that the stop 126 of the eccentric disk 114 as well as the stop 134 of the adjusting knob 132 come into position at the same time. With this starting position the next feeding of the print element 42 to the platen 18 is reached. In order to preselect a smaller feed, the adjusting knob 132 is uncoupled from the eccentric disk 114, rotated in the feed direction and again coupled; in this way for one feed the stop pin 134 comes to rest against the stop 136 before the whole radial cam curve 116 has run out. In this way a certain feed can be preselected. The preselection of certain feeds is facilitated by a scale or the like arranged on the adjusting knob 132 as well as by an index marking or the like arranged on the eccentric disk 114.

Figure 4:
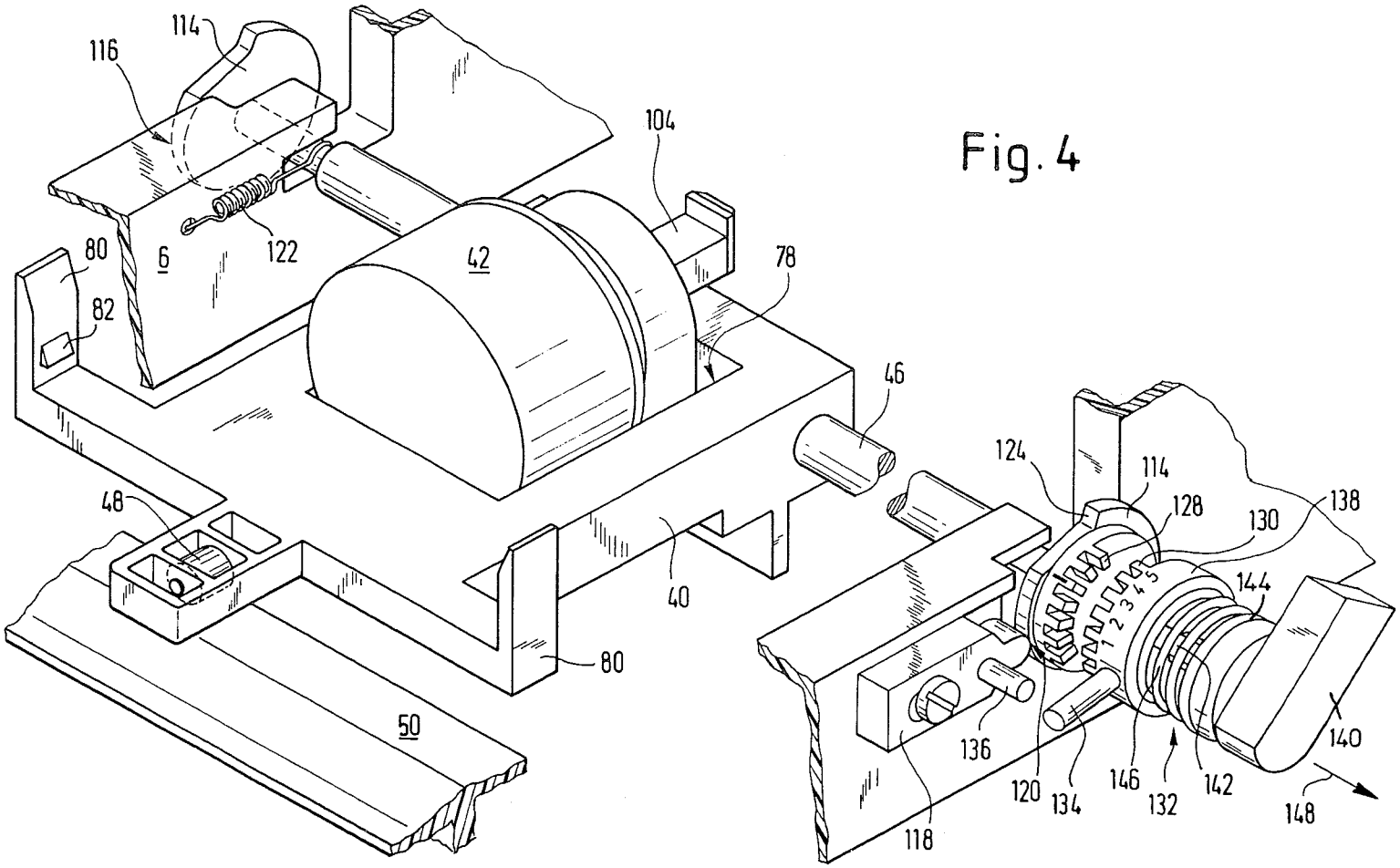
FIG. 4 shows a perspective representation of the print head arrangement as well as a feed unit for this.
Figure 5:
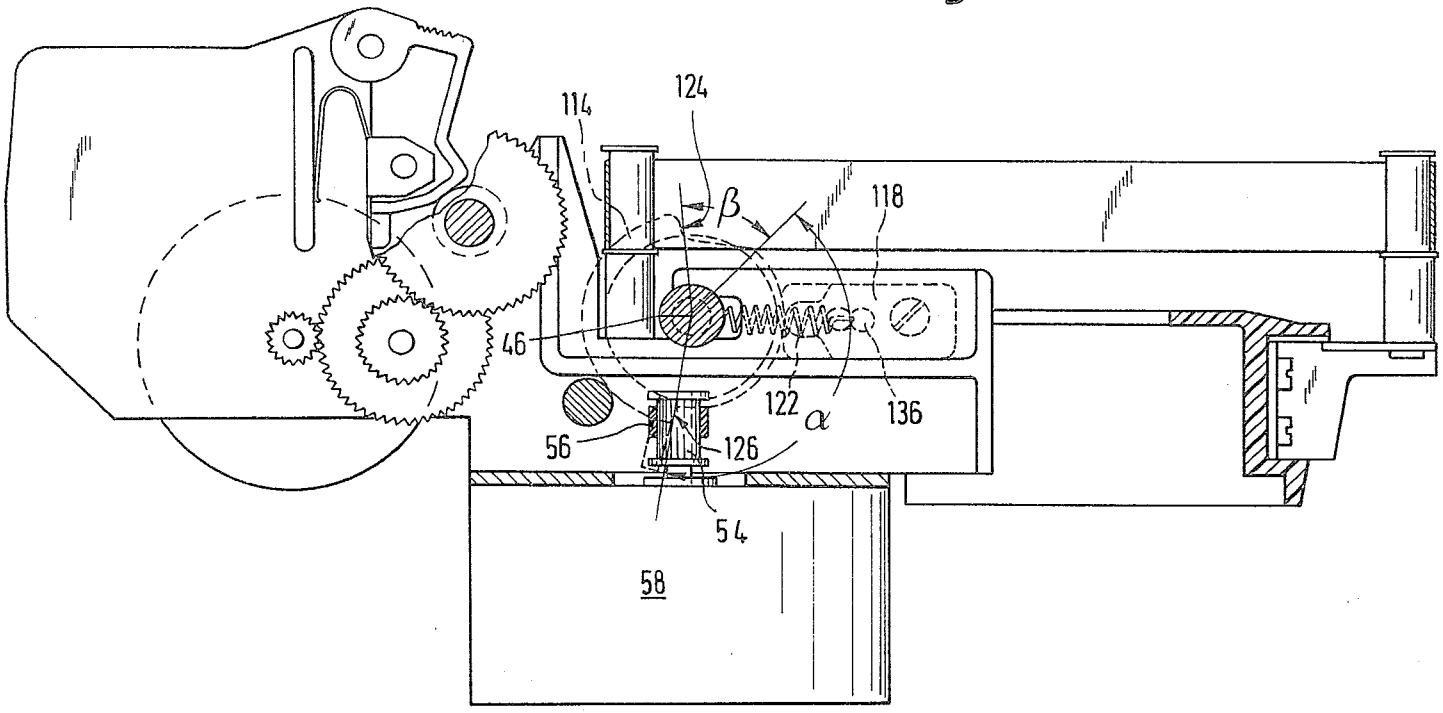
FIG. 5 shows a diagrammatic sectional representation particularly of the feed unit according to FIG. 4.

As FIGS. 2 and 4 show, the adjusting knob 132 consists of a clutch part 138 as well as a handle part 140. The clutch part 138 and handle part 140 can be connected together by fingers 142 formed on the handle part and catching in the clutch part. There is an end disk 144 arranged fixed on the supporting shaft 46. Between the clutch part 138 and the end disk 144 is arranged a pressure spring. By pulling the handle part 140 in the direction of the arrow 148, the clutch part 138 is carried along against the force of the pressure spring 146. When the handle 144 is released, the clutch part 138 is automatically recoupled with the eccentric disk.

We claim:

1. Apparatus for receiving and locating a printer ink ribbon cartridge and a printer element relative to a print plane through which the ribbon runs in normal operation comprising:

a carrier constructed to receive and hold a printer ink ribbon cartridge and a printer element in operative association with one another and having a head part disposed parallel to and adjacent the print plane;

first locking means on said carrier for receiving and holding said cartridge in place;

second locking means on said carrier for receiving and holding said printer element in place;

a plurality of flange plates disposed on said head part in parallel spaced relationship and having parallel front ink ribbon guide edges, a pair of pins disposed in parallel spaced apart relationship on said head part, said flange plates and pins being located such that in the direction of ink ribbon travel the ribbon first passes at least one flange plate, and then passes one pin, and then passes at least one more flange plate before passing the second pin and the final flange plate, at least two of said flange plates further having guide means comprising upper edges having different angularities with respect to the print plane for receiving and progressively guiding the ink ribbon from the upper edges to the print plane as the ink ribbon is caused to be fed in the direction of ribbon travel relative to the flange plates, each of said pins having an axial height which is greater than the height of the flange plates.

2. Apparatus as defined in claim 1 wherein said printer element includes a needle channel which extends toward the print plane, said flange plates which have front edges lying supportingly adjacent and on opposite sides of the needle channel when the printer element is held in position on the said carrier.

3. Apparatus as defined in claim 1 wherein the first locking means for receiving and holding the cartridge comprises a pair of parallel, spaced-apart upstanding spring fingers having cam type projections formed thereon to snap over and hold the cartridge therebetween when in the operative position.

4. Apparatus as defined in claim 1 further including a mounting bar adapted to receive and support said head piece, said mounting bar extending parallel to said print plane;

means for adjusting the position of the mounting bar parallel to itself thereby to adjust the position of the head part relative to the print plane.

* * * * *